US010712681B2

(12) United States Patent
Masuda et al.

(10) Patent No.: US 10,712,681 B2
(45) Date of Patent: Jul. 14, 2020

(54) TONER, TONER STORAGE UNIT, IMAGE FORMING APPARATUS, AND METHOD FOR MANUFACTURING TONER

(71) Applicants: Minoru Masuda, Shizuoka (JP); Atsushi Yamamoto, Tokyo (JP); Taichi Nemoto, Shizuoka (JP); Junichi Watanabe, Shizuoka (JP); Taro Araki, Shizuoka (JP); Takeshi Shibuya, Shizuoka (JP)

(72) Inventors: Minoru Masuda, Shizuoka (JP); Atsushi Yamamoto, Tokyo (JP); Taichi Nemoto, Shizuoka (JP); Junichi Watanabe, Shizuoka (JP); Taro Araki, Shizuoka (JP); Takeshi Shibuya, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/259,006

(22) Filed: Jan. 28, 2019

(65) Prior Publication Data

US 2019/0235405 A1 Aug. 1, 2019

(30) Foreign Application Priority Data

Feb. 1, 2018 (JP) ..... 2018-016300

(51) Int. Cl.
*G03G 9/087* (2006.01)
*G03G 9/08* (2006.01)
(Continued)

(52) U.S. Cl.
CPC ..... *G03G 9/08755* (2013.01); *G03G 9/0806* (2013.01); *G03G 9/08733* (2013.01);
(Continued)

(58) Field of Classification Search
CPC ..... G03G 9/08755; G03G 15/0865; G03G 9/08797; G03G 9/08782; G03G 15/2014; G03G 9/08733; G03G 9/0806
See application file for complete search history.

(56) References Cited

U.S. PATENT DOCUMENTS 5,721,083 A 2/1998 Masuda et al.
2013/0108950 A1 5/2013 Yamamoto et al.
(Continued)

FOREIGN PATENT DOCUMENTS

JP 2010-077419 4/2010
JP 2010-151996 7/2010
(Continued)

*Primary Examiner* — Thorl Chea
(74) *Attorney, Agent, or Firm* — Oblon, McClelland, Maier & Neustadt, L.L.P.

(57) ABSTRACT

A toner is provided that contains a crystalline polyester resin comprising a polycondensed resin of a dicarboxylic acid represented by the following formula (1) with a diol represented by the following formula (2). A content of a cyclic ester represented by the following formula (3) in the toner, measured by a thermal extraction gas chromatographic mass spectrometry at a thermal extraction temperature of 160° C., is from 1 to 200 ppm in terms of toluene:

Formula (1)

$$HOOC-(CH_2)_n-COOH$$

where n represents an integer of from 2 to 12;

Formula (2)

$$HO-(CH_2)_m-OH$$

where m represents an integer of from 2 to 12; and
(Continued)

Formula (3)

where n represents an integer of from 2 to 12, m represents an integer of from 2 to 12, and m+n≥6 is satisfied.

7 Claims, 1 Drawing Sheet

(51) Int. Cl.
*G03G 15/08* (2006.01)
*G03G 15/20* (2006.01)

(52) U.S. Cl.
CPC ..... *G03G 9/08782* (2013.01); *G03G 9/08797* (2013.01); *G03G 15/0865* (2013.01); *G03G 15/2014* (2013.01)

(56) References Cited

U.S. PATENT DOCUMENTS

| | | | | |
|---|---|---|---|---|
| 2017/0050204 | A1 | 2/2017 | Shitara et al. | |
| 2017/0261876 | A1 | 9/2017 | Kabata et al. | |
| 2017/0363980 | A1* | 12/2017 | Nagata ..... | G03G 9/08708 |
| 2018/0259865 | A1 | 9/2018 | Takeyama et al. | |
| 2018/0267417 | A1 | 9/2018 | Mizoguchi et al. | |

FOREIGN PATENT DOCUMENTS

| | | |
|---|---|---|
| JP | 2013-092659 | 5/2013 |
| JP | 2015-043049 | 3/2015 |

* cited by examiner

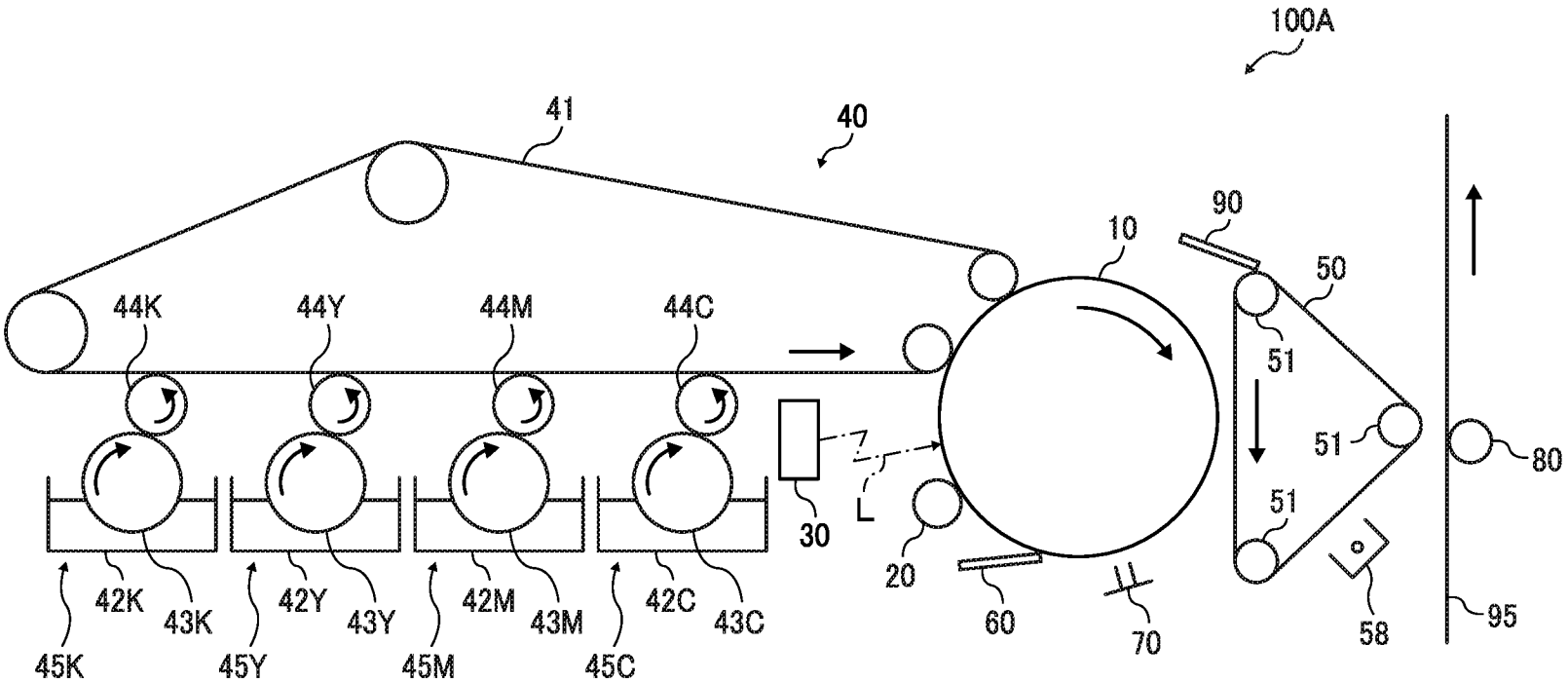
100A
80
95
58
50
51
51
51
90
10
70
60
20
L
30
40
41
44C
43C
42C
45C
44M
43M
42M
45M
44Y
43Y
42Y
45Y
44K
43K
42K
45K

TONER, TONER STORAGE UNIT, IMAGE FORMING APPARATUS, AND METHOD FOR MANUFACTURING TONER

CROSS-REFERENCE TO RELATED APPLICATIONS

This patent application is based on and claims priority pursuant to 35 U.S.C. § 119(a) to Japanese Patent Application No. 2018-016300, filed on Feb. 1, 2018, in the Japan Patent Office, the entire disclosure of which is hereby incorporated by reference herein.

BACKGROUND

Technical Field

The present disclosure relates to a toner, a toner storage unit, an image forming apparatus, and a method for manufacturing toner.

Description of the Related Art

Conventionally, an electrophotographic image forming apparatus, such as a printer, has been used that forms an image with toner. The electrophotographic image forming apparatus forms an electrostatic latent image on a photoconductor and develops the electrostatic latent image with toner to form a toner image. The toner image is transferred onto a sheet of paper and melted by heat to be fixed thereon. In the process of fixing the toner image by this image forming apparatus, a large amount of electric power is required to heat and melt the toner. Therefore, low-temperature fixability is one property of toner to be taken into consideration for energy saving.

In attempting to improve low-temperature fixability of toner, a toner containing a crystalline polyester resin as a binder resin has been proposed.

On the other hand, ultrafine particles generated from printers and copiers have been considered as a problem recently. Printers and copiers are often installed in rooms where people work, and humans inhale ultrafine particles generated from printers and copiers.

Ultrafine particles having a size of several nanometers to several hundred nanometers are generated when a material is volatilized, aggregated, or sublimated (from gas to solid) by application of heat. In particular, toner generates a large amount of ultrafine particles, which is considered as a problem, since toner is directly heated by a fixing device and the resulting toner image has a large surface area.

SUMMARY

In accordance with some embodiments of the present invention, a toner is provided. The toner comprises a crystalline polyester resin comprising a polycondensed resin of a dicarboxylic acid represented by the following formula (1) with a diol represented by the following formula (2), and a content of a cyclic ester represented by the following formula (3) in the toner, measured by a thermal extraction gas chromatographic mass spectrometry at a thermal extraction temperature of 160° C., is from 1 to 200 ppm in terms of toluene:

Formula (1)

$$HOOC-(CH_2)_n-COOH$$

where n represents an integer of from 2 to 12;

Formula (2)

$$HO-(CH_2)_m-OH$$

where m represents an integer of from 2 to 12; and

Formula (3)

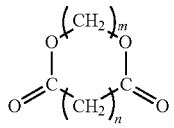

where n represents an integer of from 2 to 12, m represents an integer of from 2 to 12, and m+n≥6 is satisfied.

In accordance with some embodiments of the present invention, a toner storage unit is provided. The toner storage unit includes a container, and the above-described toner stored in the container.

In accordance with some embodiments of the present invention, an image forming apparatus is provided. The image forming apparatus includes: an electrostatic latent image bearer; an electrostatic latent image forming device configured to form an electrostatic latent image on the electrostatic latent image bearer; a developing device containing the above-described toner, configured to develop the electrostatic latent image formed on the electrostatic latent image bearer with the toner to form a toner image; a transfer device configured to transfer the toner image formed on the electrostatic latent image bearer onto a surface of a recording medium; and a fixing device configured to fix the toner image on the surface of the recording medium.

In accordance with some embodiments of the present invention, a method for manufacturing toner is provided. The method includes the processes of polycondensing a dicarboxylic acid represented by the following formula (1) with a diol represented by the following formula (2) to obtain a crystalline polyester resin and reprecipitating the crystalline polyester resin to purify the crystalline polyester resin. The method may further include the processes of: dissolving or dispersing the crystalline polyester resin in a solvent to prepare an oil phase; dispersing the oil phase in an aqueous phase to prepare oil droplets containing the crystalline polyester resin; and removing the solvent from the oil droplets. Alternatively, the method may further include the processes of dispersing the crystalline polyester resin in an aqueous solution containing a surfactant to prepare particles of the crystalline polyester resin; and mixing an aggregating agent in the aqueous solution to aggregate the particles of the crystalline polyester resin.

BRIEF DESCRIPTION OF THE DRAWING

A more complete appreciation of the disclosure and many of the attendant advantages thereof will be readily obtained as the same becomes better understood by reference to the following detailed description when considered in connection with the accompanying drawing, which is intended to depict example embodiments of the present invention and should not be interpreted to limit the scope thereof. The accompanying drawing is not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawing. In describing embodiments illustrated in the drawing, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner containing a crystalline polyester resin is provided that exhibits excellent low-temperature fixability and generates ultrafine particles in a smaller amount.

The inventors of the present invention have studied on a toner containing a crystalline polyester resin and have found the following.

That is, the toner containing a crystalline polyester resin has improved low-temperature fixability but generates ultrafine particles in a larger amount.

The amount of generation of ultrafine particles from the toner containing a crystalline polyester resin is influenced by the presence of a cyclic ester that is produced as a by-product in synthesizing the crystalline polyester resin.

Specifically, the amount of generation of ultrafine particles is reduced when the amount of production of the cyclic ester is reduced.

In view of the above, the inventors of the present invention provide a toner containing a crystalline polyester resin in which the content of the cyclic ester is adjusted to be in a specific range by suppressing the production of the cyclic ester. This toner exhibits excellent low-temperature fixability and also generates ultrafine particles in a smaller amount.

More specifically, the toner contains a crystalline polyester resin comprising a polycondensed resin of a specific dicarboxylic acid with a specific diol, and the content of a specific cyclic ester in the toner is within a specific range.

Accordingly, a toner that exhibits excellent low-temperature fixability and generates ultrafine particles in a smaller amount is provided.

To adjust the content of the specific cyclic ester in the toner to be within a specific range, the toner is preferably manufactured by a method described below.

That is, first, the crystalline polyester resin is obtained by a polycondensation of a dicarboxylic acid represented by the above formula (1) with a diol represented by the above formula (2). The crystalline polyester resin obtained by the polycondensation is reprecipitated to be purified. By this process, the amount of the cyclic ester is adjusted. It is effective to purify the crystalline polyester resin for adjusting the content of the specific cyclic ester in the toner to be within a specific range.

The method for manufacturing the toner of the present embodiment is described in detail below.

Toner

The toner according to an embodiment of the present invention contains at least a crystalline polyester resin as a binder resin. The toner may further contain another binder resin other than the crystalline polyester resin. Examples of the binder resin other than the crystalline polyester resin include, but are not limited to, an amorphous polyester resin (to be described in detail later). The toner may further optionally contain other components such as a release agent and a colorant.

In addition, the toner of the present embodiment contains a cyclic ester represented by the above formula (3) in a specific amount.

Crystalline Polyester Resin

The crystalline polyester resin has a heat melting property such that the viscosity rapidly decreases at around the fixing start temperature due to its high crystallinity.

When the crystalline polyester resin having such characteristics is contained in the toner together with other binder resin, for example, an amorphous polyester resin to be described later, the toner exhibits the following characteristics. That is, the crystalline polyester resin maintains good storage stability below the melting start temperature due to its crystallinity, but upon reaching the melting start temperature, the crystalline polyester resin melts and rapidly reducing its viscosity. The crystalline polyester resin then compatibilizes with the amorphous polyester resin and together rapidly reduces viscosity to fix on a recording medium. As a result, the toner exhibits excellent heat-resistant storage stability and low-temperature fixability. The toner also exhibits a wide releasable range (i.e., the difference between the lower-limit fixable temperature and the high-temperature offset generating temperature).

The crystalline polyester resin is obtained from a polyol and a polycarboxylic acid or derivative thereof, such as a polycarboxylic acid anhydride and a polycarboxylic acid ester.

In the present disclosure, the crystalline polyester resin refers to a resin obtained from a polyol and a polycarboxylic acid or a derivative thereof, such as a polycarboxylic acid anhydride and a polycarboxylic acid ester. Accordingly, modified polyester resins, such as a prepolymer having urethane bond and/or urea bond and a resin obtained by cross-linking and/or elongating the prepolymer do not fall within the crystalline polyester resin of the present disclosure.

Specifically, the toner of the present embodiment contains a crystalline polyester resin obtained by a polycondensation of a dicarboxylic acid represented by the following formula (1) with a diol represented by the following formula (2).

Formula (1)

$$HOOC-(CH_2)_n-COOH$$

Here, n represents an integer of from 2 to 12.

Formula (2)

$$HO-(CH_2)_m-OH$$

Here, m represents an integer of from 2 to 12.

The crystalline polyester resin comprises a copolymer resin having a structural unit derived from the formula (1) and another structural unit derived from the formula (2).

Preferably, the polycondensed resin of the dicarboxylic acid represented by the formula (1) with the diol represented by the formula (2) accounts for 95% by mol or more of the crystalline polyester resin.

More preferably, the crystalline polyester resin is obtained by a polycondensation of a carboxylic acid component containing 95% by mol or more of the dicarboxylic acid represented by the formula (1) with an alcohol component containing 95% by mol or more of the diol represented by the formula (2). Generally, to enhance crystallinity of a crystalline polyester resin, molecular chains should be orderly arranged. If the main chain of the resin has an irregular structure, molecular chains cannot be orderly arranged and crystallinity will be lowered.

If the crystalline polyester resin has a side chain containing other compound, steric hindrance will occur and crystallinity will be lowered. Therefore, it is preferable that the crystalline polyester resin has no side chain.

By enhancing crystallinity of the crystalline polyester resin, deterioration of heat-resistant storage stability of the toner is effectively prevented.

The crystalline polyester resin exhibits high crystallinity and maintains good heat-resistant storage stability at temperatures below the melting start temperature due to the high crystallinity.

Preferably, the melting point of the crystalline polyester resin is from 60° C. to 80° C. When the melting point is 60° C. or higher, the crystalline polyester resin is prevented from easily melting at low temperatures, thus effectively preventing deterioration of heat resistant storage stability of the toner. When the melting point is 80° C. or lower, the crystalline polyester resin is prevented from insufficiently melting when heated at the time of fixing the toner, thus effectively preventing deterioration of low-temperature fixability.

The molecular weight of the crystalline polyester resin is not particularly limited and may be appropriately selected depending on the purpose. Generally, as the molecular weight distribution becomes narrower and the molecular weight becomes lower, low-temperature fixability improves. In addition, as the amount of low-molecular-weight components increases, heat-resistant storage stability deteriorates. In view of this, preferably, ortho-dichlorobenzene-soluble matter in the crystalline polyester resin has a weight average molecular weight (Mw) of from 3,000 to 30,000, a number average molecular weight (Mn) of from 1,000 to 10,000, and a ratio Mw/Mn of from 1.0 to 10, when measured by GPC (gel permeation chromatography). More preferably, the weight average molecular weight (Mw) is from 5,000 to 15,000, the number average molecular weight (Mn) is from 2,000 to 10,000, and the ratio Mw/Mn is from 1.0 to 5.0.

The acid value of the crystalline polyester resin is not particularly limited and may be appropriately selected depending on the purpose. However, the acid value is preferably 5 mgKOH/g or more, more preferably 10 mgKOH/g or more, for achieving a desired level of low-temperature fixability in terms of affinity for paper. On the other hand, for improving high-temperature offset resistance, the acid value is preferably 45 mgKOH/g or less.

The hydroxyl value of the crystalline polyester resin is not particularly limited and can be appropriately selected according to the purpose. However, the hydroxyl value is preferably in the range of from 0 to 50 mgKOH/g, more preferably from 2 to 20 mgKOH/g, for achieving a desired level of low-temperature fixability and a good level of charge property.

The content of the crystalline polyester resin is not particularly limited and may be appropriately selected according to the purpose. Preferably, the content of the crystalline polyester resin in 100 parts by mass of the toner is in the range of from 1 to 20 parts by mass, more preferably from 2 to 10 parts by mass.

When the content is 1 part by mass or more, sharply-melting property of the crystalline polyester resin is sufficient and deterioration of low-temperature fixability is effectively prevented. When the content is 20 parts by mass or less, deterioration of heat-resistant storage stability and generation of image fog are effectively prevented. When the content is within the more preferred range of from 2 to 10 parts by mass, image quality and fixing stability are more improved.

Cyclic Ester

In synthesizing the crystalline polyester resin, a cyclic ester represented by the following formula (3) is derived from the crystalline polyester resin as a by-product.

This cyclic ester is a substance produced by a cyclic esterification reaction between one molecule of a dicarboxylic acid and one molecule of a diol, each of which is a monomer of the crystalline polyester resin.

Formula (3)

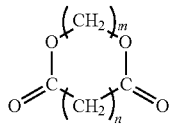

Here, n represents an integer of from 2 to 12, m represents an integer of from 2 to 12, and $m+n \geq 6$ is satisfied.

Preferably, the cyclic ester represented by the formula (3) further satisfies $m+n \leq 20$, more preferably $m+n \leq 18$.

The cyclic ester represented by the formula (3) is produced because a straight-chain saturated aliphatic dicarboxylic acid and a straight-chain saturated aliphatic diol have high mobility and are able to easily form a cyclic structure. This cyclic ester easily volatilizes from the toner when heated since the molecular weight is not so large and no terminal polar is contained due to its cyclic structure. The volatilized cyclic substance has moderate polarity due to the presence of ester group and coagulates with other substances to produce ultrafine particles.

Thus, to reduce the amount of generation of ultrafine particles from an image forming apparatus, it is effective to reduce the amount of the cyclic ester represented by the formula (3) in the toner.

In the present embodiment, the content of the cyclic ester represented by the formula (3) in the toner is specified.

Specifically, the content of the cyclic ester represented by the formula (3) in the toner is from 1 to 200 ppm in terms of toluene, when measured by a thermal extraction gas chromatographic mass spectrometry at a thermal extraction temperature of 160° C. Preferably, the content of the cyclic ester represented by the formula (3) in the toner is from 1 to 150 ppm, more preferably from 5 to 100 ppm, in terms of toluene.

When the content of the cyclic ester represented by the formula (3) is 1 ppm or more, the crystalline polyester resin is contained in the toner in an amount sufficient for exhibiting low-temperature fixability. When the content of the cyclic ester represented by the formula (3) is 200 ppm or less, the amount of generation of ultrafine particles is reduced.

The thermal extraction gas chromatographic mass spectrometry may be performed under the following conditions. The toner is heated in a thermal extraction gas chromatographic mass spectrometer at 160° C. for 10 minutes so that volatile components are introduced therein, whereby the cyclic ester represented by the formula (3) is detected. The amount generation of the cyclic ester is determined from a calibration curve of toluene, that is, determined in terms of toluene.

The thermal extraction gas chromatographic mass spectrometry may be performed under the following measurement conditions.

Measuring Device and Measurement Conditions

Thermal extraction device: PY2020D manufactured by Frontier Laboratories Ltd.

Thermal extraction condition: 160° C./10 min

Interface temperature: 260° C.

Gas chromatographic mass spectrometer: QP-2010 manufactured by Shimadzu Corporation Column: UA-5 (5% diphenyldimethyl polysiloxane) manufactured by Frontier Laboratories Ltd., having a length of 30 m, an inner diameter of 0.25 mm, and a film thickness of 0.25 μm Injection temperature: 330° C.

Column temperature rising: kept at 40° C. (for 10 minutes), raised at 10° C./min, and kept at 330° C. (for 10 minutes)

Column flow rate: 1.0 mL/min

Ionization method: EI method (70 eV)

Injection mode: Split (1:100)

To reduce the content of the cyclic ester represented by the formula (3) in the toner, it is effective to reduce the amount of production of the cyclic ester represented by the formula (3) in synthesizing the crystalline polyester resin.

To reduce the amount of production of the cyclic ester represented by the formula (3) that is a by-product in synthesizing the crystalline polyester resin, the following method is effective.

That is, the crystalline polyester resin is synthesized by a dehydration reaction between the dicarboxylic acid monomer represented by the formula (1) and the diol monomer represented by the formula (2). During this reaction, the reaction temperature is preferably kept as low as possible so that the molecular weight of the resulting polyester is increased over time. Generally, when synthesizing a polyester resin, the reaction temperature is relatively high so as to shorten the synthesis time. However, when the reaction temperature is high, the carboxylic acid at the terminal of a resin molecule comes into contact with the ester bond of its own molecule and causes a transesterification, thus generating the cyclic ester. Therefore, by lowering the reaction temperature in synthesizing the polyester, the reaction for generating the cyclic ester is suppressed.

A polyester resin is generally synthesized by reacting a carboxylic acid monomer with an alcohol monomer in equimolar amounts, and generation of the cyclic ester is suppressed by making the amount of the alcohol monomer slightly larger. This is because it is more probable that the terminal of the resin becomes hydroxyl group, so that the transesterification reaction with the ester group of its own molecule is less likely to occur. Alternatively, it may be possible to end-capping the terminal of the resin in synthesizing the crystalline polyester resin so as to suppress the occurrence of transesterification reaction.

It may be also possible to deactivate the catalyst for esterification to suppress the occurrence of transesterification reaction. Specifically, a catalyst deactivator may be added after the reaction is completed to stop the action of the catalyst. Also, it is possible to suppress generation of the cyclic ester by more reducing the pressure to accelerate dehydration.

Furthermore, it is also effective to purify the crystalline polyester resin for reducing the amount of the cyclic ester represented by the formula (3). Specifically, unreacted monomers and oligomers can be removed by reprecipitating the crystalline polyester resin using a good solvent and a poor solvent.

A method of purifying the crystalline polyester resin is described in detail below.

First, a solvent A capable of dissolving the resulting resin and a solvent B capable of dissolving only a very-low-molecular-weight component of the resulting resin and being infinitely miscible with the solvent A are selected.

The resulting resin is completely dissolved in the solvent A. The solution is then gradually poured into the solvent resin B so that only a high-molecular-weight component of the resulting resin is precipitated.

After the precipitation, the solvents are removed to dry out a resin from which a very-low-molecular-weight component has been removed.

The solvents A and B are selected depending on the type of the resulting resin. When the resulting resin is the crystalline polyester resin, the following solvents A and B may be used.

Examples of the solvent A include, but are not limited to, tetrahydrofuran, ethyl acetate, butyl acetate, isopropyl acetate, acetone, methyl ethyl ketone, N,N-dimethylformamide, dimethylsulfoxide, hexafluoroisopropanol, chloromethane, methylene chloride, chloroform, and carbon tetrachloride. Examples of the solvent B include, but are not limited to, water, methanol, ethanol, and isopropanol.

The amount of the solvent A to be used for purifying the crystalline polyester resin is preferably such an amount that the crystalline polyester resin is completely dissolved in the solvent A and the viscosity of the solution is relatively low. When the viscosity is high, it becomes difficult for the solution to be mixed with the solvent B when the resin has been reprecipitated. Specifically, it is preferable that the amount of the solvent A is from 1 to 10 times the mass of the crystalline polyester resin.

In addition, it is preferable that the amount of the solvent B is excessive relative to the whole amount of the solution of the crystalline polyester resin in the solvent A. When the amount of the solvent B is small, the amount of precipitation of the crystalline polyester resin decreases because of the influence of the solvent A. Specifically, it is preferable that the amount of the solvent B is from 10 to 100 times the mass of the solution of the crystalline polyester resin in the solvent A.

Depending on the type of toner manufacturing method, cyclic esters may be synthesized and sometimes increased in amount. For example, a pulverization method that is one type of toner manufacturing methods includes the process of kneading the crystalline polyester resin with other materials. In this process, a transesterification reaction occurs to produce cyclic esters because the materials are applied with a high temperature and a shear force. Therefore, the toner is preferably manufactured by a polymerization method that produces toner under low temperatures.

Accordingly, the toner of the present embodiment that contains a crystalline polyester resin is preferably manufactured by a dissolution suspension method or an emulsion aggregation method.

Binder Resin

The toner according to an embodiment of the present invention may further contain another binder resin other than the crystalline polyester resin. The binder resin other than the crystalline polyester resin is not particularly limited and can be appropriately selected from known resins. Specific examples of the binder resin include, but are not limited to, vinyl polymers (e.g., homopolymers of a styrene monomer, an acrylic monomer, or a methacrylic monomer, and copolymers of at least two of the monomers), polyester polymers, polyol resins, phenol resins, silicone resins, polyurethane resins, polyamide resins, furan resins, epoxy resins, xylene resins, terpene resins, coumarone indene resins, polycarbonate resins, and petroleum resins.

Among these resins, an amorphous polyester polymer (amorphous polyester resin) is preferably contained in the toner of the present embodiment as a binder resin.

The styrene monomer is not particularly limited and may be appropriately selected depending on the purpose. Specific examples of the styrene monomer include, but are not limited to, styrene, o-methylstyrene, m-methylstyrene, p-methyl styrene, p-phenylstyrene, p-ethyl styrene, 2,4-dimethyl styrene, p-n-amyl styrene, p-tert-butyl styrene, p-n-hexyl styrene, p-n-octylstyrene, p-n-nonyl styrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof.

The acrylic monomer is not particularly limited and may be appropriately selected depending on the purpose. Examples of the acrylic monomer include, but are not limited to, acrylic acid and acrylic acid esters. Specific examples of the acrylic acid esters include, but are not limited to, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Examples of the methacrylic monomer include, but are not limited to, methacrylic acid and methacrylic acid esters. Specific examples of the methacrylic acid esters include, but are not limited to, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethyl aminoethyl methacrylate, and diethyl aminoethyl methacrylate.

Examples of other monomers constituting the vinyl polymers or copolymers are not particularly limited and may be appropriately selected depending on the purpose. For example, the following (1) to (18) can be used.

(1) Monoolefins, such as ethylene, propylene, butylene, and isobutylene.

(2) Polyenes, such as butadiene and isoprene.

(3) Vinyl halides, such as vinyl chloride, vinylidene chloride, vinyl bromide, and vinyl fluoride.

(4) Vinyl esters, such as vinyl acetate, vinyl propionate, and vinyl benzoate.

(5) Vinyl ethers, such as vinyl methyl ether, vinyl ethyl ether, and vinyl isobutyl ether.

(6) Vinyl ketones, such as vinyl methyl ketone, vinyl hexyl ketone, and methyl isopropenyl ketone.

(7) N-Vinyl compounds, such as N-vinyl pyrrole, N-vinyl carbazole, N-vinyl indole, and N-vinyl pyrrolidone.

(8) Vinyl naphthalenes.

(9) Acrylic or methacrylic acid derivatives, such as acrylonitrile, methacrylonitrile, and acrylamide.

(10) Unsaturated dibasic acids, such as maleic acid, citraconic acid, itaconic acid, alkenyl succinic acid, fumaric acid, and mesaconic acid.

(11) Unsaturated dibasic anhydrides, such as maleic anhydride, citraconic anhydride, itaconic anhydride, and alkenyl succinic anhydride.

(12) Unsaturated dibasic acid monoesters, such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenyl succinic acid monomethyl ester, fumaric acid monomethyl ester, and mesaconic acid monomethyl ester.

(13) Unsaturated dibasic acid esters, such as dimethyl maleate and dimethyl fumarate.

(14) α,β-Unsaturated acids, such as crotonic acid and cinnamic acid.

(15) α,β-Unsaturated anhydrides, such as crotonic anhydride and cinnamic anhydride.

(16) Monomers having carboxyl group, such as anhydrides of α,β-unsaturated acids with lower fatty acids; and alkenyl malonic acid, alkenyl glutaric acid, alkenyl adipic acid, and anhydrides and monoesters thereof.

(17) Hydroxyalkyl esters of acrylic or methacrylic acids, such as 2-hydroxyethyl acrylate, 2-hydroxyethyl methacrylate, and 2-hydroxypropyl methacrylate.

(18) Monomers having hydroxyl group, such as 4-(1-hydroxy-1-methylbutyl)styrene and 4-(1-hydroxy-1-methylhexyl)styrene.

The vinyl polymer or copolymer, as a binder resin, may have a cross-linked structure formed by a cross-linker having two or more vinyl groups.

Specific examples of the cross-linker include, but are not limited to: aromatic divinyl compounds, such as divinylbenzene and divinylnaphthalene; diacrylate compounds bonded with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate; dimethacrylate compounds bonded with an alkyl chain, such as ethylene glycol dimethacrylate, 1,3-butylene glycol dimethacrylate, 1,4-butanediol dimethacrylate, 1,5-pentanediol dimethacrylate, 1,6-hexanediol dimethacrylate, and neopentyl glycol dimethacrylate; diacrylate compounds bonded with an alkyl chain having ether bond, such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate; and dimethacrylate compounds, such as diethylene glycol dimethacrylate, triethylene glycol dimethacrylate, tetraethylene glycol dimethacrylate, polyethylene glycol #400 dimethacrylate, polyethylene glycol #600 dimethacrylate, and dipropylene glycol dimethacrylate.

Specific examples of the cross-linker further include diacrylate compounds and dimethacrylate compounds in which acrylates or methacrylates are bonded with a chain having an aromatic group and ether bond.

Specific examples of the cross-linker further include polyester-type diacrylate compounds such as MANDA (available from Nippon Kayaku Co., Ltd.).

Specific examples of the cross-linker further include polyfunctional cross-linkers, such as pentaerythritol triacrylate, trimethylolethane triacrylate, trimethylolpropane triacrylate, tetramethylolmethane tetraacrylate, oligoester acrylate, pentaerythritol trimethacrylate, trimethylolethane trimethacrylate, trimethylolpropane trimethacrylate, tetramethylolmethane tetramethacrylate, oligoester methacrylate, triallyl cyanurate, and triallyl trimellitate Among these cross-linkers, aromatic divinyl compounds (especially divinylbenzene) and diacrylate compounds in which acrylates are bonded with a chain having an aromatic group and one ether bond are preferable for fixability and offset resistance of the binder resin. In particular, combinations of monomers which produce a styrene copolymer or styrene-acrylic copolymer are preferable.

Specific examples of a polymerization initiator used for preparing the vinyl polymer or copolymer include, but are not limited to, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), methyl ethyl ketone peroxide, acetylacetone peroxide, cyclohexanone peroxide, 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α-(tert-butylperoxy)isopropyl benzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl) peroxycarbonate, acetylcyclohexylsulfonyl peroxide, tert-butyl peroxyacetate, tert-butyl peroxyisobutyrate, tert-butyl peroxy-2-ethyl hexanoate, tert-butyl peroxylaurate, tert-butyl oxybenzoate, tert-butyl peroxyisopropyl carbonate, di-tert-butyl peroxyisophthalate, tert-butyl peroxyallyl carbonate, isoamyl peroxy-2-ethyl hexanoate, di-tert-butyl peroxyhexahydroterephthalate, and tert-butyl peroxyazelate.

When the binder resin is a styrene-acrylic resin, a molecular weight distribution of tetrahydrofuran-soluble (THF-soluble) matter in the resin, measured by gel permeation chromatography (GPC), has at least one peak in a number average molecular weight range of from 3,000 to 50,000. Preferably, the molecular weight distribution of the binder resin has at least one peak in a molecular weight range of 100,000 or above for fixability, offset resistance, and storage stability. In addition, preferably, the molecular weight distribution of THF-soluble matter in the binder resin is such that components having a molecular weight of 100,000 or less account for 50% to 90%. More preferably, the molecular weight distribution of THF-soluble matter in the binder resin has a main peak within a molecular weight range of from 5,000 to 30,000. Most preferably, the molecular weight distribution of THF-soluble matter in the binder resin has a main peak within a molecular weight range of from 5,000 to 20,000.

Examples of monomers constituting the amorphous polyester resin include, but are not limited to, divalent alcohols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a diol obtained by a polymerization between bisphenol A and a cyclic ether (e.g., ethylene oxide, propylene oxide).

By using a polyol having a valence of 3 or more or an acid having a valence of 3 or more in combination, the resulting polyester resin can have a cross-linked structure. The used amount of such a polyol or an acid should be controlled such that the resulting resin is not prevented from dissolving in an organic solvent.

Specific examples of the polyol having a valence of 3 or more include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanethiol, 2-methyl-1,2,4-butanetriol, trimethylolethane, trimethylolpropane, and 1,3,5-trihydroxybenzene.

Specific examples of acid components constituting the amorphous polyester resin include, but are not limited to, benzene dicarboxylic acids (e.g., phthalic acid, isophthalic acid, terephthalic acid) and anhydrides thereof, alkyl dicarboxylic acids (e.g., succinic acid, adipic acid, sebacic acid, azelaic acid) and anhydrides thereof, unsaturated dibasic acids (e.g., maleic acid, citraconic acid, itaconic acid, alkenyl succinic acid, fumaric acid, mesaconic acid), and unsaturated dibasic acid anhydrides (e.g., maleic acid anhydride, citraconic acid anhydride, itaconic acid anhydride, alkenyl succinic acid anhydride).

Specific examples of polycarboxylic acid components having a valence of 3 or more include, but are not limited to, trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxy)methane, 1,2,7,8-octanetetracarboxylic acid, enpol trimmer acid, and anhydrides and partial lower alkyl esters of these compounds.

When the binder resin is an amorphous polyester resin, a molecular weight distribution of THF-soluble matter in the resin preferably has at least one peak in a number average molecular weight range of from 3,000 to 50,000 for fixability and offset resistance of the toner. Preferably, the molecular weight distribution of THF-soluble matter in the binder resin is such that components having a molecular weight of 100,000 or less account for 60% to 100%. In addition, preferably, the molecular weight distribution of the binder resin has at least one peak in a molecular weight range of from 5,000 to 20,000.

In the present disclosure, the molecular weight distribution of the binder resin is measured by gel permeation chromatography (GPC) using THF as a solvent.

When the binder resin is an amorphous polyester resin, the acid value thereof is preferably from 0.1 to 100 mgKOH/g, more preferably from 0.1 to 70 mgKOH/g, and most preferably from 0.1 to 50 mgKOH/g.

Examples of the binder resin further include a resin containing at least one of the vinyl polymer component and the polyester polymer component and further containing a monomer component capable of reacting with both of these components. Among the monomers constituting the polyester polymer component, those capable of reacting with the vinyl polymer component may include, for example, unsaturated dicarboxylic acids (e.g., phthalic acid, maleic acid, citraconic acid, itaconic acid) and anhydrides thereof. Examples of the monomers constituting the vinyl polymer component include monomers having carboxyl group or hydroxy group, acrylic acid esters, and methacrylic acid esters.

When a polyester polymer component, a vinyl polymer component, and other resin are used in combination, preferably, a resin having an acid value of from 0.1 to 50 mgKOH/g accounts for 60% by mass or more of the total binder resin.

The binder resin other than the crystalline polyester resin preferably has a glass transition temperature (Tg) of from 35° C. to 80° C., more preferably from 50° C. to 70° C., for storage stability of the toner. When Tg is 35° C. or higher, deterioration of the toner under high-temperature atmosphere and the occurrence of offset when fixing the toner are effectively prevented. When Tg is 80° C. or less, deterioration of fixability is effectively prevented.

Relationship between Crystalline Polyester Resin and Amorphous Polyester Resin

The toner according to the present embodiment that contains a crystalline polyester resin favorably exhibits low-temperature fixability when further contains a large amount of a polyester resin having good compatibility with the crystalline polyester resin. Therefore, it is preferable that the toner contains an amorphous polyester resin as a binder resin other than the crystalline polyester resin.

Preferably, the content of the polyester resin, i.e., the total content of the crystalline polyester resin and the amorphous polyester resin, in the toner is in the range of from 50% to 90% by mass of the toner amount.

Here, the toner amount refers to the mass of toner that is the total mass of toner constituents such as binder resin components, release agent components, colorant components, external additive components, charge control agents, fluidity improving agents. For example, in Table 2 described below, the toner amount (100%) is calculated by adding the mass of the binder resin components, the release agent components, the colorant components, and the external additive components.

Other Components

The toner according to an embodiment of the present invention may further contain other components such as a release agent, a colorant, fine resin particles, a charge control agent, an external additive, a fluidity improving agent, a cleanability improving agent, and a magnetic material.

Release Agent

The release agent is not particularly limited and may be appropriately selected from known materials. Preferred examples of the release agent include waxes. Specific examples of the waxes include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, microcrystalline wax, petrolatum wax). In addition to these natural waxes, synthetic hydrocarbon waxes (e.g., Fischer-Tropsch wax, polyethylene wax) and synthetic waxes (e.g., ester wax, ketone wax, ether wax) may also be used. Furthermore, the following materials are also usable as the release agent: fatty acid amides such as 12-hydroxystearic acid amide, stearic acid amide, phthalic anhydride imide, and chlorinated hydrocarbon; homopolymers and copolymers of polyacrylates (e.g., poly-n-stearyl methacrylate, poly-n-lauryl methacrylate), which are low-molecular-weight crystalline polymers, such as copolymer of n-stearyl acrylate and ethyl methacrylate; and crystalline polymers having a long alkyl group on a side chain.

Among these release agents, ester waxes are preferable. When an ester wax is mixed in the toner, releasability of the toner from a fixing roller or a fixing belt improves. In addition, the toner containing the ester wax generates fine particles derived from the wax in a smaller amount, which is suitable for the present invention, because the ester wax is less volatile by heat. More preferably, impurities and low-molecular-weight components have been removed from the ester wax. This is because impurities and low-molecular-weight components may volatilize to increase the amount of generation of fine particles. Most raw materials of the ester wax have high purity and it is easy to reduce impurities.

A typical ester wax is synthesized by an esterification between a long-chain fatty acid and an aliphatic alcohol. Even when the long-chain fatty acid or the aliphatic alcohol remains as a reaction residue, the reaction residue hardly volatilizes because raw materials thereof have a polar group. Therefore, generation of fine particles is suppressed.

As the release agent, hydrocarbon waxes such as paraffin wax, micro-crystalline wax, Fischer-Tropsch wax, polyethylene wax, and polypropylene wax are preferable for fixing releasability. However, hydrocarbon waxes have a certain degree of molecular weight distribution, and low-molecular-weight components volatilize to produce fine particles. In particular, the low-molecular-weight components easily volatilize because of having no polar group, thereby producing fine particles.

Since hydrocarbon waxes generally contain a certain amount of low-molecular-weight components, ester waxes are more preferred as the release agent for preventing generation of fine particles. In the case of using a hydrocarbon wax, it is preferable that the amount of low-molecular-weight components is reduced as much as possible.

The melting point of the release agent is not particularly limited and may be appropriately selected according to the purpose, but is preferably from 60° C. to 80° C. When the melting point is 60° C. or higher, the release agent is prevented from easily melting at low temperatures, thus effectively preventing deterioration of heat resistant storage stability. When the melting point is 80° C. or less, the release agent sufficiently melts in the fixable temperature range within which the resin melts, thus effectively preventing the occurrence of fixing offset and defective image.

Preferably, the content of the release agent in 100 parts by mass of the toner is in the range of from 2 to 10 parts by mass, more preferably from 3 to 8 parts by mass. When the content is 2 parts by mass or more, high-temperature offset resistance at the time of fixing and low-temperature fixability are good. When the content is 10 parts by mass or less, deterioration of heat-resistant storage stability and the occurrence of image fog are effectively prevented. When the content is within the more preferred range of from 3 to 8 parts by mass, image quality and fixing stability are more improved.

Colorant

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Each of these materials can be used alone or in combination with others.

The content of the colorant is not particularly limited and may be appropriately selected according to the purpose. Preferably, the content of the colorant in 100 parts by mass of the toner is in the range of from 1 to 15 parts by mass, more preferably from 3 to 10 parts by mass.

The colorant can be combined with a resin to be used as a master batch. Specific examples of the resin to be used for the master batch include, but are not limited to, the above-described amorphous polyester resin, polymers of styrene or a derivative thereof (e.g., polystyrene, poly-p-chlorostyrene, polyvinyl toluene), styrene-based copolymers (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Each of these materials can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Fine Resin Particles

The resin of the fine resin particles is not particularly limited as long as it is capable of forming an aqueous dispersion thereof, and can be appropriately selected according to the purpose. Specific examples of the resin of the fine resin particles include, but are not limited to, thermoplastic resins and thermosetting resins, such as vinyl resin, polyurethane resin, epoxy resin, polyester resin, polyamide resin, polyimide resin, silicon resin, phenol resin, melamine resin, urea resin, aniline resin, ionomer resin, and polycarbonate resin. Each of these materials can be used alone or in combination with others. In particular, at least one of vinyl resin, polyurethane resin, epoxy resin, and polyester resin is preferably used because an aqueous dispersion of fine spherical particles thereof are easily obtainable. The vinyl resin refers to a homopolymer or copolymer of vinyl monomers. Specific examples of the vinyl resin include, but are not limited to, styrene-(meth)acrylate resin, styrene-butadiene copolymer, (meth)acrylic acid-acrylate polymer, styrene-acrylonitrile copolymer, styrene-maleic anhydride copolymer, and styrene-(meth)acrylic acid copolymer.

Charge Control Agent

The charge control agent is not particularly limited and may be appropriately selected depending on the purpose. Specific examples of the charge control agent include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of commercially available charge control agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), all available from Japan Carlit Co., Ltd.; and cooper phthalocyanine, perylene, quinacridone, azo pigments, and polymers having a functional group such as a sulfonic acid group, a carboxyl group, and a quaternary ammonium group.

Preferably, the content of the charge control agent in 100 parts by mass of the toner is in the range of from 0.1 to 10 parts by mass, more preferably from 0.2 to 5 parts by mass. When the content is 10 parts by mass or less, deterioration of developer fluidity and/or image density can be effectively prevented because the charge of the toner is not so large that the effect of the charge control agent is not reduced and the electrostatic force between the toner and the developing roller is not increased. The charge control agent may be melt-kneaded with the master batch or the binder resin and thereafter dissolved or dispersed in an organic solvent, or directly dissolved or dispersed in an organic solvent. Alternatively, the charge control agent may be fixed on the surface of the resulting toner particles.

External Additive

Examples of the external additives include, but are not limited to, fine oxide particles, fine inorganic particles, fine hydrophobized inorganic particles, and combinations thereof.

The external additive is not particularly limited and may be appropriately selected depending on the purpose. Specific examples of the external additive include, but are not limited to, fine silica particles, hydrophobized silica, metal salts of fatty acids (e.g., zinc stearate, aluminum stearate), metal oxides (e.g., titania, alumina, tin oxide, antimony oxide), and fluoropolymers.

Specific preferred examples of the external additive include, but are not limited to, fine particles of hydrophobized silica, titania, titanium oxide, and alumina. Specific examples of commercially-available fine particles of silica include, but are not limited to, R972, R974, RX200, RY200, R202, R805, and R812 (available from Nippon Aerosil Co., Ltd.). Specific examples of commercially-available fine particles of titania include, but are not limited to, P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation).

Specific examples of commercially-available fine particles of hydrophobized titanium oxide include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

The fine particles of hydrophobized oxides, hydrophobized silica, hydrophobized titania, and hydrophobized alumina can be obtained by treating fine particles of oxides, silica, titania, and alumina, respectively, which are hydrophilic, with a silane coupling agent such as methyltrimethoxysilane, methyltriethoxysilane, and octyltrimethoxysilane. In addition, silicone-oil-treated fine oxide particles and silicone-oil-treated fine inorganic particles, treated with a silicone oil optionally upon application of heat, are also preferable.

Specific examples of the silicone oil include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methyl styrene-modified silicone oil. Specific examples of the fine inorganic particles include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium dioxide are preferable.

The content of the external additive is not particularly limited and may be appropriately selected according to the purpose. Preferably, the content of the external additive in 100 parts by mass of the toner is in the range of from 0.1 to 5 parts by mass, more preferably from 0.3 to 3 parts by mass.

Fluidity Improving Agent

The fluidity improving agent is not particularly limited and can be appropriately selected according to the purpose as long as it is capable of increasing hydrophobicity by surface treatment and preventing deterioration of fluidity and charge property even under high humidity conditions. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils. Preferably, the above-described silica and titanium oxide are surface-treated with such a fluidity improving agent to become hydrophobic silica and hydrophobic titanium oxide, respectively.

Cleanability Improving Agent

The cleanability improving agent is added to the toner so that the developer remaining on a photoconductor or a primary transfer medium without being transferred is removable. The cleanability improving agent is not particularly limited and can be appropriately selected according to the purpose. Specific examples of the cleanability improving agent include, but are not limited to: metal salts of fatty acids, such as zinc stearate and calcium stearate; and fine particles of polymers prepared by soap-free emulsion polymerization, such as fine polymethyl methacrylate particles and fine polystyrene particles. Preferably, the particle size distribution of the fine particles of polymers is as narrow as possible. More preferably, the volume average particle diameter thereof is in the range of from 0.01 to 1 μm.

Magnetic Material

The magnetic material is not particularly limited and may be appropriately selected depending on the purpose. Specific examples of the magnetic material include, but are not limited to, iron powder, magnetite, and ferrite. In particular, those having white color tone are preferable.

Calculation and Analysis of Contents of Toner Constituents

Various properties of the crystalline polyester resin, the binder resin (e.g., amorphous polyester resin), and the release agent, such as Tg, acid value, hydroxyl value, molecular weight, and melting point, may be measured by any method. For example, such properties may be measured from the single body of each toner constituent. Alternatively, Tg, acid value, hydroxyl value, molecular weight, melting point, and mass ratio of each toner constituent may be measured from that separated from the toner by gel permeation chromatography (GPC), etc., according to analysis procedures to be described later.

For example, each toner constituent can be separated from the toner by GPC in the following manner.

In a GPC measurement using THF (tetrahydrofuran) as a mobile phase, the eluate is divided into fractions by a fraction collector, and the fractions corresponding to the desired molecular weight portion in the total area of the elution curve are collected.

The collected fractions of the eluate are condensed and dried by an evaporator or the like. The resulting solid is dissolved in a deuterated solvent, such as deuterated chloroform or deuterated THF, and subjected to $^{1}$H-NMR measurement to determine integrated ratio of each element and calculate the constitutional monomer ratio in the eluted components.

Alternatively, the constitutional monomer ratio may be determined by hydrolyzing the condensed eluate with sodium hydroxide or the like, and subjecting the decomposition product to a qualitative quantitative analysis by high-performance liquid chromatography (HPLC).

Separation of Toner Constituents

Toner constituents can be separated from the toner in the following manner.

First, 1 g of the toner is put in 100 mL of THF and stirred at 25° C. for 30 minutes to obtain a solution in which THF-soluble matter is dissolved.

The solution is filtered with a membrane filter having an opening of 0.2 μm to separate (isolate) THF-soluble matter from the toner.

The THF-soluble matter is dissolved in THF to prepare a sample for GPC measurement. The sample is injected into a GPC instrument.

A fraction collector, disposed at the eluate discharge port of the GPC instrument, collects a fraction of the eluate at every predetermined count. Every time the collected fractions correspond to 5% of the area of the elution curve (from the rising of the curve), the collected fractions are separated.

Each separated eluate in an amount of 30 mg is dissolved in 1 mL of deuterated chloroform. As a standard substance, 0.05% by volume of tetramethylsilane (TMS) is further added thereto.

The resulting solution is poured in a glass tube having a diameter of 5 mm and subjected to an NMR measurement using a nuclear magnetic resonance spectrometer (JNM-AL400 available from JEOL Ltd.) to obtain a spectrum. The measurement is performed at a temperature of from 23° C. to 25° C., and the number of accumulation is 128.

The monomer composition and constitutional ratio of the toner constituents, such as the crystalline polyester resin and the amorphous polyester resin, can be determined from the peak integral ratio of the spectrum.

Specifically, a compositional ratio of monomers can be determined from an integral ratio determined by peak assignment.

Examples of peak assignment are as follows.

Around 8.25 ppm: derived from benzene ring of trimellitic acid (for one hydrogen atom)

Around 8.07 to 8.10 ppm: derived from benzene ring of terephthalic acid (for four hydrogen atoms)

Around 7.1 to 7.25 ppm: derived from benzene ring of bisphenol A (for four hydrogen atoms)

Around 6.8 ppm: derived from benzene ring of bisphenol A (for four hydrogen atoms) and double bond of fumaric acid (for two hydrogen atoms)

Around 5.2 to 5.4 ppm: derived from methine of propylene oxide adduct of bisphenol A (for one hydrogen atom)

Around 3.7 to 4.7 ppm: derived from methylene of propylene oxide adduct bisphenol A (for two hydrogen atoms) and methylene of ethylene oxide adduct of bisphenol A (for four hydrogen atoms)

Around 1.6 ppm: derived from methyl group of bisphenol A (for six hydrogen atoms)

As a result of peak assignment, the collected fractions of the eluate in which the crystalline polyester resin accounts for 90% or more can be treated as the crystalline polyester resin. Similarly, the collected fractions of the eluate in which the amorphous polyester resin accounts for 90% or more can be treated as the amorphous polyester resin.

Toner Properties

Measurement of Melting Point and Glass Transition Temperature (Tg)

Melting points and glass transition temperatures (Tg) can be measured with a DSC (differential scanning calorimeter) system (Q-200 available from TA Instruments).

More specifically, melting points and glass transition temperatures (Tg) can be measured in the following manner.

First, about 5.0 mg of a sample is put in an aluminum sample container. The sample container is put on a holder unit and set in an electric furnace. The temperature is raised from −80° C. to 150° C. at a temperature rising rate of 10° C./min ("first temperature rising") in nitrogen atmosphere. The temperature is thereafter lowered from 150° C. to −80° C. at a temperature falling rate of 10° C./min and raised to 150° C. again at a temperature rising rate of 10° C./min ("second temperature rising"). In each of the first temperature rising and the second temperature rising, a DSC curve is obtained by the differential scanning calorimeter (Q-200 available from TA Instruments).

The obtained DSC curves are analyzed with an analysis program installed in Q-200. By selecting the DSC curve obtained in the first temperature rising, a glass transition temperature in the first temperature rising can be determined. Similarly, by selecting the DSC curve obtained in the second temperature rising, a glass transition temperature in the second temperature rising can be determined.

In addition, by selecting the DSC curve obtained in the first temperature rising with an analysis program installed in Q-200, an endothermic peak temperature in the first temperature rising can be determined as a melting point in the first temperature rising. Similarly, by selecting the DSC curve obtained in the second temperature rising, an endothermic peak temperature in the second temperature rising can be determined as a melting point in the second temperature rising.

In the present disclosure, Tg1st and Tg2nd denote glass transition temperatures measured in the first temperature rising and the second temperature rising, respectively, especially when the sample is a toner.

In the present disclosure, glass transition temperature and the melting point of each toner constituent, such as the crystalline polyester resin, the amorphous polyester resin, and the release agent, are Tg and the endothermic peak temperature, respectively, measured in the second temperature rising, unless otherwise specified. The glass transition temperature measured in the second temperature rising is defined as Tg.

Measurement of Acid Value

In the present disclosure, the acid value of the binder resin in the toner is measured based on the following method according to JIS (Japanese Industrial Standards) K-0070. (1) A measurement sample is prepared by previously removing components other than the binder resin (polymer component) from the toner. Alternatively, the acid values and contents of the components other than the binder resin component are previously measured. The measurement sample is pulverized and 0.5 to 2.0 g thereof is precisely weighed. This weight is identified as the weight W (g) of the polymer component. In the case of measuring the acid value of the binder resin from the toner, the acid values and the contents of the colorant, the magnetic material, or the like are separately measured and the acid value of the binder resin is determined by calculation. (2) The measurement sample is dissolved in 150 ml of a mixed liquid of toluene/ethanol (volume ratio: 4/1) in a 300-mL beaker. (3) The resulting solution is titrated by a potentiometric titrator using a 0.1 mol/L ethanol solution of KOH. (4) The consumed amount of the KOH solution in the titration is identified as S (mL). The consumed amount of the KOH solution in a blank titration is identified as B (mL). The acid value is calculated from the following formula (i). In the formula (i), f represents the factor of KOH.

$$\text{Acid Value(mgKOH/g)}=[(S-B)\times f\times 5.61]/W \quad \text{(i)}$$

Method for Manufacturing Toner

The method for manufacturing the toner is not particularly limited and may be appropriately selected according to the purpose. Specific examples thereof include a kneading/pulverization method, a dissolution suspension method, and an emulsion aggregation method. Depending on the type of toner manufacturing method, cyclic esters derived from the crystalline polyester resin may be produced and sometimes increased in amount. For example, a pulverization method that is one type of toner manufacturing methods includes the process of kneading the crystalline polyester resin with other materials. In this process, a transesterification reaction occurs to produce cyclic esters because the materials are applied with a high temperature and a shear force. Therefore, the toner is preferably manufactured by a polymerization method that produces toner under low temperatures.

In a dissolution suspension method or an emulsion aggregation method, heat having a temperature of 100° C. or more is not applied.

Accordingly, the toner of the present embodiment that contains a crystalline polyester resin is preferably manufactured by a dissolution suspension method or an emulsion aggregation method.

By the dissolution suspension method, the toner can be manufactured in the following manner.

First, an oil phase is prepared by mixing a binder resin solution, a colorant dispersion liquid, and a release agent dispersion liquid. An aqueous phase containing a dispersant is also prepared. The aqueous phase and the oil phase are mixed to produce oil droplets containing toner materials in the aqueous phase. The solvent is removed from the oil droplets and the resulting dispersion is washed and dried out to obtain a mother toner. The mother toner is mixed with an external additive, thereby preparing a polymerized toner.

By the emulsion aggregation method, the toner can be manufactured in the following manner.

Each toner material is dispersed in a surfactant-containing aqueous solution at a fine particle diameter. After the dispersion liquid of the toner material is mixed with each other, an aggregating agent is added to the mixture while the mixture is being stirred, and the mixture is heated to grow the aggregated products to have a desired particle diameter. The resulting liquid dispersion is washed and dried out to obtain a mother toner. The mother toner is mixed with an external additive, thereby preparing a polymerized toner.

Developer

A developer according to an embodiment of the present invention comprises at least the above-described toner and optionally other components such as a carrier.

Accordingly, a developer that exhibits excellent low-temperature fixability and generates ultrafine particles in a smaller amount is provided.

The developer may be either one-component developer or two-component developer. To be used for high-speed printers corresponding to recent improvement in information processing speed, two-component developer is preferable, because the lifespan of the printer can be extended.

In the case of one-component developer, even when toner supply and toner consumption are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of two-component developer, even when toner supply and toner consumption are repeatedly performed for a long period of time, the particle diameter of the toner fluctuates very little. Thus, even when the developer is stirred in a developing device for a long period of time, developability and image quality remain good and stable.

Carrier

The carrier is not particularly limited and may be appropriately selected according to the purpose, but the carrier preferably comprises a core material and a resin layer that covers the core material.

Core Material

The core material is not particularly limited and may be appropriately selected depending on the purpose. Specific examples of the core material include, but are not limited to, manganese-strontium materials having a magnetization of from 50 to 90 emu/g and manganese-magnesium materials having a magnetization of from 50 to 90 emu/g. For securing image density, high magnetization materials, such as iron powders having a magnetization of 100 emu/g or more and magnetites having a magnetization of from 75 to 120 emu/g, are preferable. Additionally, low magnetization materials, such as copper-zinc materials having a magnetization of from 30 to 80 emu/g, are preferable for improving image quality, because such materials are capable of reducing the impact of the magnetic brush to a photoconductor.

Each of these materials can be used alone or in combination with others.

The volume average particle diameter of the core material is not particularly limited and may be appropriately selected according to the purpose, but is preferably in the range of from 10 to 150 μm, more preferably from 40 to 100 μm. When the volume average particle diameter is 10 μm or more, the amount of fine particles in the carrier is not so large that the magnetization per carrier particle is not lowered, thereby effectively preventing carrier scattering. When the volume average particle diameter is 150 μm or less, the specific surface area of the carrier particle is not so small that toner is effectively prevented from scattering. Therefore, solid portions in full-color images may be reliably reproduced.

The toner of the present embodiment can be mixed with the carrier to prepare a developer.

Toner Storage Unit

In the present disclosure, a toner storage unit refers to a unit that has a function of storing toner and that is storing the above toner. The toner storage unit may be in the form of, for example, a toner storage container, a developing device, or a process cartridge.

In the present disclosure, the toner storage container refers to a container storing the toner.

The developing device refers to a device storing the toner and having a developing unit configured to develop an electrostatic latent image into a toner image with the toner.

The process cartridge refers to a combined body of an electrostatic latent image bearer (simply "image bearer") with a developing unit storing the toner, detachably mountable on an image forming apparatus. The process cartridge may further include at least one of a charger, an irradiator, and a cleaner.

An image forming apparatus in which the toner storage unit is installed can perform image forming operation utilizing the above-described toner that provides excellent low-temperature fixability, heat-resistant storage stability, and image quality.

Image Forming Apparatus and Image Forming Method

An image forming apparatus according to an embodiment of the present invention includes at least an electrostatic latent image bearer, an electrostatic latent image forming device, and a developing device, and optionally other devices.

An image forming method according to an embodiment of the present invention includes at least an electrostatic latent image forming process and a developing process, and optionally other processes.

The image forming method is preferably performed by the image forming apparatus. The electrostatic latent image forming process is preferably performed by the electrostatic latent image forming device. The developing process is preferably performed by the developing device. Other optional processes are preferably performed by other optional devices.

More preferably, the image forming apparatus includes: an electrostatic latent image bearer; an electrostatic latent image forming device configured to form an electrostatic latent image on the electrostatic latent image bearer; a developing device containing the above-described toner, configured to develop the electrostatic latent image formed on the electrostatic latent image bearer with the toner to form a toner image; a transfer device configured to transfer the toner image formed on the electrostatic latent image bearer onto a surface of a recording medium; and a fixing device configured to fix the toner image on the surface of the recording medium.

More preferably, the image forming method includes: an electrostatic latent image forming process in which an electrostatic latent image is formed on an electrostatic latent image bearer; a developing process in which the electrostatic latent image formed on the electrostatic latent image bearer is developed with the above-described toner to form a toner image; a transfer process in which the toner image is formed on the electrostatic latent image bearer is transferred onto a surface of a recording medium; and a fixing process in which the toner image is fixed on the surface of the recording medium.

In the developing device and the developing process, the above-described toner is used. Preferably, the toner image is formed with a developer containing the above-described toner and other components such as a carrier.

An image forming apparatus according to an embodiment of the present invention is described below with reference to the drawing. A full-color image forming apparatus 100A includes a photoconductor drum 10 (hereinafter "photoconductor 10") serving as the electrostatic latent image bearer, a charging roller 20 serving as a charger, an irradiator 30 serving as an irradiator, a developing device 40 serving as the developing device, an intermediate transfer medium 50, a cleaner 60 equipped with a cleaning blade serving as a cleaner, and a neutralization lamp 70 serving as a neutralizer.

The intermediate transfer medium 50 is in the form of an endless belt and is stretched taut by three rollers 51 disposed inside the loop of the endless belt. The intermediate transfer medium 50 is movable in the direction indicated by arrow in the drawing. One or two of the three rollers 51 also function(s) as transfer bias roller(s) for applying a predetermined transfer bias (primary transfer bias) to the intermediate transfer medium 50. In the vicinity of the intermediate transfer medium 50, a cleaner 90 equipped with a cleaning blade is disposed. In the vicinity of the intermediate transfer medium 50, a transfer roller 80, serving as the transfer device, that applies a transfer bias to a transfer sheet 95, serving as a recording medium, for secondarily transferring a toner image thereon is disposed facing the intermediate transfer medium 50. Around the intermediate transfer medium 50, a corona charger 58 that gives charge to the toner image on the intermediate transfer medium 50 is disposed between the contact point of the intermediate transfer medium 50 with the photoconductor 10 and the contact point of the intermediate transfer medium 50 with the transfer sheet 95 relative to the direction of rotation of the intermediate transfer medium 50.

The developing device 40 includes a developing belt 41 serving as a developer bearer; and a black developing unit 45K, a yellow developing unit 45Y, a magenta developing unit 45M, and a cyan developing unit 45C each disposed around the developing belt 41. The black developing unit 45K includes a developer container 42K, a developer supply roller 43K, and a developing roller 44K. The yellow developing unit 45Y includes a developer container 42Y, a developer supply roller 43Y, and a developing roller 44Y. The magenta developing unit 45M includes a developer container 42M, a developer supply roller 43M, and a developing roller 44M. The cyan developing unit 45C includes a developer container 42C, a developer supply roller 43C, and a developing roller 44C. The developing belt 41 is in the form of an endless belt and stretched taut by multiple belt rollers. A part of the developing belt 41 is in contact with the photoconductor 10.

Next, the image forming method according to one embodiment is described in detail below.

An image processor (hereinafter "IPU") generates image signals of four colors including Y (yellow), M (magenta), C (cyan), and K (black) based on image data sent to IPU.

Next, the image processor transmits the image signals of Y, M, C, and K to a writing unit. The writing unit modulates four laser beams corresponding to Y, M, C and K image signals and scans photoconductor drums having been charged by a charger to form electrostatic latent images thereon. For example, the photoconductor drums may include the first photoconductor drum corresponding to K, the second photoconductor drum corresponding to Y, the third photoconductor drum corresponding to M, the fourth photoconductor drum corresponding to C.

Next, developing units form toner images of respective colors on the respective photoconductor drums. A sheet feeder feeds a transfer sheet onto a transfer belt. Transfer chargers sequentially transfer the toner images on the photoconductor drums onto the transfer sheet.

After completion of the transfer process, the transfer sheet is conveyed to a fixing unit. The fixing unit fixes the transferred toner image on the transfer sheet.

After completion of the transfer process, residual toner particles remaining on the photoconductor drums are removed by respective cleaners.

EXAMPLES

The embodiments of the present invention are further described in detail with reference to the Examples but is not limited to the following Examples. In the following descriptions, "parts" represents parts by mass and "% (percent)" represents percent by mass unless otherwise specified.

Synthesis of Crystalline Polyester Resin C1

In a 5-liter four-neck flask equipped with a nitrogen inlet tube, a dewatering tube, a stirrer, and a thermocouple, 76.5 parts of sebacic acid and 23.5 parts of ethylene glycol were contained and allowed to react in the presence of 500 ppm (based on the resin components) of titanium tetraisopropoxide at 180° C. for 10 hours, thereafter at 200° C. for 3 hours, and further under a pressure of 8.3 kPa for 2 hours. Thus, a crystalline polyester resin C1 was prepared.

Purification for Crystalline Polyester Resin C2

A part of the above-prepared crystalline polyester resin C1 was reprecipitated to remove unreacted monomers and oligomers.

Next, 100 parts of the crystalline polyester resin C1 was dissolved in 200 parts of THF (tetrahydrofuran) to prepare a TI-IF solution of the crystalline polyester resin C1.

A vessel equipped with a stirrer was charged with 60,000 parts of methanol, and the THF solution of the crystalline polyester resin C1 was gradually added to the vessel while the methanol is being stirred with the stirrer. As a result, it was confirmed that white methanol-insoluble matter was precipitated. After the whole THF solution had been added to the vessel, stirring was stopped and the mixture was allowed to stand for precipitation. The supernatant liquid was thereafter removed, and the precipitate was filtered and washed with methanol. Further, the precipitate was gradually heated from 30° C. to 70° C. under a reduced pressure of from 10 to 15 mmHg to remove the remaining solvent. Thus, a crystalline polyester resin C2 was prepared.

Synthesis of Crystalline Polyester Resin C3

In a 5-liter four-neck flask equipped with a nitrogen inlet tube, a dewatering tube, a stirrer, and a thermocouple, 63.1 parts of sebacic acid and 36.9 parts of 1,6-hexanediol were contained and allowed to react in the presence of 500 ppm (based on the resin components) of titanium tetraisopropoxide at 180° C. for 10 hours, thereafter at 200° C. for 3 hours, and further under a pressure of 8.3 kPa for 2 hours. Thus, a crystalline polyester resin C3 was prepared.

Purification for Crystalline Polyester Resin C4

A part of the above-prepared crystalline polyester resin C3 was reprecipitated to remove unreacted monomers and oligomers.

Next, 100 parts of the crystalline polyester resin C3 was dissolved in 200 parts of THF to prepare a THF solution of the crystalline polyester resin C3.

A vessel equipped with a stirrer was charged with 60,000 parts of methanol, and the THF solution of the crystalline polyester resin C3 was gradually added to the vessel while the methanol is being stirred with the stirrer. As a result, it was confirmed that white methanol-insoluble matter was precipitated. After the whole THF solution had been added to the vessel, stirring was stopped and the mixture was allowed to stand for precipitation. The supernatant liquid was thereafter removed, and the precipitate was filtered and washed with methanol. Further, the precipitate was gradually heated from 30° C. to 70° C. under a reduced pressure of from 10 to 15 mmHg to remove the remaining solvent. Thus, a crystalline polyester resin C4 was prepared.

Synthesis of Crystalline Polyester Resin C5

In a 5-liter four-neck flask equipped with a nitrogen inlet tube, a dewatering tube, a stirrer, and a thermocouple, 59.6 parts of sebacic acid, 4.3 parts of dodecanedioic acid, 34.9 parts of 1,6-hexanediol, and 1.2 parts of ethylene glycol were contained, so that the sebacic acid and the 1,6 hexanediol account for 94% by mol of the constituent monomers of the crystalline polyester, and allowed to react in the presence of 500 ppm (based on the resin components) of titanium tetraisopropoxide at 180° C. for 10 hours, thereafter at 200° C. for 3 hours, and further under a pressure of 8.3 kPa for 2 hours. Thus, a crystalline polyester resin C5 was prepared.

Purification for Crystalline Polyester Resin C6

A part of the above-prepared crystalline polyester resin C5 was reprecipitated to remove unreacted monomers and oligomers.

Next, 100 parts of the crystalline polyester resin C5 was dissolved in 200 parts of THF to prepare a THF solution of the crystalline polyester resin C5.

A vessel equipped with a stirrer was charged with 60,000 parts of methanol, and the THF solution of the crystalline polyester resin C5 was gradually added to the vessel while the methanol is being stirred with the stirrer. As a result, it was confirmed that white methanol-insoluble matter was precipitated. After the whole THF solution had been added to the vessel, stirring was stopped and the mixture was allowed to stand for precipitation. The supernatant liquid was thereafter removed, and the precipitate was filtered and washed with methanol. Further, the precipitate was gradually heated from 30° C. to 70° C. under a reduced pressure of from 10 to 15 mmHg to remove the remaining solvent. Thus, a crystalline polyester resin C6 was prepared.

Synthesis of Crystalline Polyester Resin C7

In a 5-liter four-neck flask equipped with a nitrogen inlet tube, a dewatering tube, a stirrer, and a thermocouple, 60.8 parts of sebacic acid, 2.9 parts of dodecanedioic acid, 35.5 parts of 1,6-hexanediol, and 0.8 parts of ethylene glycol were contained, so that the sebacic acid and the 1,6 hexanediol account for 96% by mol of the constituent monomers of the crystalline polyester, and allowed to react in the presence of 500 ppm (based on the resin components) of titanium tetraisopropoxide at 180° C. for 10 hours, thereafter at 200° C. for 3 hours, and further under a pressure of 8.3 kPa for 2 hours. Thus, a crystalline polyester resin C7 was prepared.

Purification for Crystalline Polyester Resin C8

A part of the above-prepared crystalline polyester resin C7 was reprecipitated to remove unreacted monomers and oligomers.

Next, 100 parts of the crystalline polyester resin C7 was dissolved in 200 parts of THF to prepare a THF solution of the crystalline polyester resin C7.

A vessel equipped with a stirrer was charged with 60,000 parts of methanol, and the THF solution of the crystalline polyester resin C7 was gradually added to the vessel while the methanol is being stirred with the stirrer. As a result, it was confirmed that white methanol-insoluble matter was precipitated. After the whole THF solution had been added to the vessel, stirring was stopped and the mixture was allowed to stand for precipitation. The supernatant liquid was thereafter removed, and the precipitate was filtered and washed with methanol. Further, the precipitate was gradually heated from 30° C. to 70° C. under a reduced pressure of from 10 to 15 mmHg to remove the remaining solvent. Thus, a crystalline polyester resin C8 was prepared.

With respect to the crystalline polyester resins C1 to C8, the amount of cyclic ester in terms of toluene measured by a thermal extraction gas chromatographic mass spectrometer at a thermal extraction temperature of 160° C., acid value, hydroxyl value, and melting point are presented in Table 1 below.

In the present disclosure, conditions of the thermal extraction gas chromatographic mass spectrometry were as follows.

Measuring Device and Measurement Conditions

Thermal extraction device: PY2020D manufactured by Frontier Laboratories Ltd.

Thermal extraction condition: 160° C./10 min

Interface temperature: 260° C.

Gas chromatographic mass spectrometer: QP-2010 manufactured by Shimadzu Corporation Column: UA-5 (5% diphenyldimethyl polysiloxane) manufactured by Frontier Laboratories Ltd., having a length of 30 m, an inner diameter of 0.25 mm, and a film thickness of 0.25 μm Injection temperature: 330° C.

Column temperature rising: kept at 40° C. (for 10 minutes), raised at 10° C./min, and kept at 330° C. (for 10 minutes)

Column flow rate: 1.0 mL/min

Ionization method: EI method (70 eV)

Injection mode: Split (1:100)

TABLE 1

| | Amount of Cyclic Ester (in terms of toluene) at Thermal Extraction Temp. of 160° C. (ppm) | Acid Value (mgKOH/g) | Hydroxyl Value (mgKOH/g) | Melting Point (° C.) |
|---|---|---|---|---|
| Crystalline Polyester Resin C1 | 17800 | 12.0 | 4.0 | 69.1 |
| Crystalline Polyester Resin C2 | 780 | 11.8 | 3.9 | 70.5 |
| Crystalline Polyester Resin C3 | 8910 | 24.9 | 3.8 | 66.8 |
| Crystalline Polyester Resin C4 | 268 | 24.3 | 3.6 | 68.1 |
| Crystalline Polyester Resin C5 | 12600 | 18.5 | 2.8 | 58.1 |
| Crystalline Polyester Resin C6 | 381 | 18.4 | 2.6 | 59.3 |
| Crystalline Polyester Resin C7 | 13000 | 16.5 | 2.8 | 67.9 |
| Crystalline Polyester Resin C8 | 381 | 18.2 | 2.5 | 69.1 |

Preparation of Crystalline Polyester Resin C1 Dispersion Liquid

A vessel equipped with a stirrer and a thermometer was charged with 100 parts of the crystalline polyester resin C1 and 400 parts of ethyl acetate. The temperature was raised to 80° C. with stirring and kept at 80° C. for 5 hours. The mixture was cooled to 20° C. over a period of 1 hour and subjected to a dispersion treatment using a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation was repeated 3 times (3 passes). Thus, a crystalline polyester resin C1 dispersion liquid was prepared.

Preparation of Crystalline Polyester Resin C2 Dispersion Liquid

A vessel equipped with a stirrer and a thermometer was charged with 100 parts of the crystalline polyester resin C2 and 400 parts of ethyl acetate. The temperature was raised to 80° C. with stirring and kept at 80° C. for 5 hours. The mixture was cooled to 20° C. over a period of 1 hour and subjected to a dispersion treatment using a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation was repeated 3 times (3 passes). Thus, a crystalline polyester resin C2 dispersion liquid was prepared.

Preparation of Crystalline Polyester Resin C3 Dispersion Liquid

A vessel equipped with a stirrer and a thermometer was charged with 100 parts of the crystalline polyester resin C3 and 400 parts of ethyl acetate. The temperature was raised to 80° C. with stirring and kept at 80° C. for 5 hours. The mixture was cooled to 20° C. over a period of 1 hour and subjected to a dispersion treatment using a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation was repeated 3 times (3 passes). Thus, a crystalline polyester resin C3 dispersion liquid was prepared.

Preparation of Crystalline Polyester Resin C4 Dispersion Liquid

A vessel equipped with a stirrer and a thermometer was charged with 100 parts of the crystalline polyester resin C4 and 400 parts of ethyl acetate. The temperature was raised to 80° C. with stirring and kept at 80° C. for 5 hours. The mixture was cooled to 20° C. over a period of 1 hour and subjected to a dispersion treatment using a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation was repeated 3 times (3 passes). Thus, a crystalline polyester resin C4 dispersion liquid was prepared.

Preparation of Crystalline Polyester Resin C6 Dispersion Liquid

A vessel equipped with a stirrer and a thermometer was charged with 100 parts of the crystalline polyester resin C6 and 400 parts of ethyl acetate. The temperature was raised to 80° C. with stirring and kept at 80° C. for 5 hours. The mixture was cooled to 20° C. over a period of 1 hour and subjected to a dispersion treatment using a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation was repeated 3 times (3 passes). Thus, a crystalline polyester resin C6 dispersion liquid was prepared.

Preparation of Crystalline Polyester Resin C8 Dispersion Liquid

A vessel equipped with a stirrer and a thermometer was charged with 100 parts of the crystalline polyester resin C8 and 400 parts of ethyl acetate. The temperature was raised to 80° C. with stirring and kept at 80° C. for 5 hours. The mixture was cooled to 20° C. over a period of 1 hour and subjected to a dispersion treatment using a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation was repeated 3 times (3 passes). Thus, a crystalline polyester resin C8 dispersion liquid was prepared.

Synthesis of Amorphous Polyester Resin L

In a reaction vessel equipped with a condenser, a stirrer, and a nitrogen inlet tube, 24.6 parts of terephthalic acid, 5.4 parts of adipic acid, 33.2 parts of ethylene oxide 2.2 mol adduct of bisphenol A, 36.8 parts of propylene oxide 2.2 mol adduct of bisphenol A, and 0.2 parts of dibutyltin oxide were contained and allowed to react at 230° C. under normal pressure for 4 hours and subsequently under reduced pressures of from 10 to 15 mmHg for 5 hours. Thus, an amorphous polyester resin L was prepared.

Synthesis of Amorphous Polyester Resin H

In a reaction vessel equipped with a condenser, a stirrer, and a nitrogen inlet tube, 25.3 parts of terephthalic acid, 5.6 parts of adipic acid, 30.9 parts of ethylene oxide 2.2 mol adduct of bisphenol A, 34.3 parts of propylene oxide 2.2 mol adduct of bisphenol A, and 0.2 parts of dibutyltin oxide were contained and allowed to react at 230° C. under normal pressure for 3 hours. Next, 4 parts of trimellitic acid were put in the vessel, and the mixture was allowed to react for 2 hours and subsequently under reduced pressures of from 10 to 15 mmHg for 5 hours. Thus, an amorphous polyester resin H was prepared.

Preparation of Master Batch

First, 200 parts of water, 500 parts of a carbon black (NIPEX 60 manufactured by Degussa), and 500 parts of the amorphous polyester resin L were mixed with a HENSCHEL MIXER (manufactured Mitsui Mining and Smelting Co., Ltd.). The mixture was kneaded with a double roll at 120° C. for 30 minutes, thereafter rolled to cool, and pulverized with a pulverizer. Thus, a master batch 1 was prepared.

Preparation of Wax Dispersion Liquid 1

A vessel equipped with a stirrer and a thermometer was charged with 100 parts of an ester wax (WEP-3 manufactured by NOF CORPORATION) as a release agent and 400 parts of ethyl acetate. The temperature was raised to 80° C. with stirring and kept at 80° C. for 5 hours. The mixture was cooled to 20° C. over a period of 1 hour and subjected to a dispersion treatment using a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation was repeated 3 times (3 passes). Thus, a wax dispersion liquid 1 was prepared.

Preparation of Wax Dispersion Liquid 2

A vessel equipped with a stirrer and a thermometer was charged with 100 parts of a paraffin wax (HNP-9 manufactured by Nippon Seiro Co., Ltd.) as a release agent and 400 parts of ethyl acetate. The temperature was raised to 80° C. with stirring and kept at 80° C. for hours. The mixture was cooled to 20° C. over a period of 1 hour and subjected to a dispersion treatment using a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation was repeated 3 times (3 passes). Thus, a wax dispersion liquid 2 was prepared.

Example 1

Preparation of Organic Fine Particle Emulsion (Fine Particle Dispersion Liquid)

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were contained and stirred at a revolution of 400 rpm for 15 minutes. As a result, a white emulsion was obtained. The white emulsion was heated to 75° C. and subjected to a reaction for 5 hours. A 1% aqueous solution of ammonium persulfate in an amount of 30 parts was further added to the emulsion, and the mixture was aged at 75° C. for 5 hours. Thus, a fine particle dispersion liquid was prepared, that was an aqueous dispersion of a vinyl resin (i.e., a copolymer of styrene, methacrylic acid, and a sodium salt of a sulfate of ethylene oxide adduct of methacrylic acid).

The fine particles in the fine particle dispersion liquid had a volume average particle diameter of 0.14 μm when measured by an instrument LA-920 (available from HORIBA, Ltd.).

Preparation of Aqueous Phase

An aqueous phase was prepared by stir-mixing 2,240 parts of water, 80 parts of the fine particle dispersion liquid, 80 parts of a 48.5% aqueous solution of sodium dodecyl diphenyl ether disulfonate (ELEMINOL MON-7 available from Sanyo Chemical Industries, Ltd.), and 200 parts of ethyl acetate. The aqueous phase was a milky white liquid.

Preparation of Oil Phase

In a vessel, 72 parts of ethyl acetate, 25 parts of the wax dispersion liquid 1, 7.5 parts of the crystalline polyester resin C2 dispersion liquid, 61.5 parts of the amorphous polyester resin L, 20 parts of the amorphous polyester resin H, and 10 parts of the master batch 1 were contained and mixed with a TK HOMOMTXER (available from PRIMIX Corporation) at a revolution of 5,000 rpm for 120 minutes. Thus, an oil phase 1 was prepared.

Emulsification and Solvent Removal

In a vessel containing 60 parts of the aqueous phase, 40 parts of the oil phase 1 were added and mixed with a TK HOMOMIXER at a revolution of 13,000 rpm for 3 minutes. Thus, an emulsion slurry was prepared.

The emulsion slurry was contained in a vessel equipped with a stirrer and a thermometer and subjected to solvent removal at 30° C. for 8 hours and subsequently to aging at 45° C. for 4 hours. Thus, a dispersion slurry was obtained.

Washing and Drying

After 100 parts of the dispersion slurry was filtered under reduced pressures:

(1) The filter cake was mixed with 100 parts of ion-exchange water using a TK HOMOMIXER at a revolution of 12,000 rpm for 10 minutes and thereafter filtered.

(2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures.

(3) 100 parts of a 10% aqueous solution of hydrochloric acid was added to the filter cake of (2) and mixed therewith using a TK HOMOMIXER at a revolution of 12,000 rpm for 10 minutes, followed by filtration.

(4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake.

The filter cake was dried by a circulating air dryer at 45° C. for 48 hours and then filtered with a mesh having an opening of 75 μm. Thus, a mother toner 1 was prepared. The volume average particle diameter of the mother toner was 6.2 μm.

Next, 98 parts of the mother toner 1, 1.0 part of HDK-1303 available from Clariant (Japan) K.K., 1.0 part of JMT-150IB available from Tayca Corporation were mixed using a HENSCHEL MIXER. The mixture was sieved with a mesh having an opening of 25 μm. Thus, a toner of Example 1 was prepared. Here, HDK-1303 is fine silica particles and JMT-1501B is fine titanium oxide particles.

Example 2

A toner of Example 2 was prepared in the same manner as in Example 1 except that the procedures in the Preparation of Oil Phase were changed as follows.

Preparation of Oil Phase

In a vessel, 58 parts of ethyl acetate, 25 parts of the wax dispersion liquid 1, 25 parts of the crystalline polyester resin C2 dispersion liquid, 58 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, an oil phase 2 was prepared.

Example 3

A toner of Example 3 was prepared in the same manner as in Example 1 except that the procedures in the Preparation of Oil Phase were changed as follows.

Preparation of Oil Phase

In a vessel, 38 parts of ethyl acetate, 25 parts of the wax dispersion liquid 1, 50 parts of the crystalline polyester resin C2 dispersion liquid, 53 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, an oil phase 3 was prepared.

Example 4

A toner of Example 4 was prepared in the same manner as in Example 1 except that the procedures in the Preparation of Oil Phase were changed as follows.

Preparation of Oil Phase

In a vessel, 0 part of ethyl acetate, 25 parts of the wax dispersion liquid 1, 100 parts of the crystalline polyester resin C2 dispersion liquid, 43 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, an oil phase 4 was prepared.

Example 5

A toner of Example 5 was prepared in the same manner as in Example 1 except that the procedures in the Preparation of Oil Phase were changed as follows.

Preparation of Oil Phase

In a vessel, 72 parts of ethyl acetate, 25 parts of the wax dispersion liquid 1, 7.5 parts of the crystalline polyester resin C4 dispersion liquid, 61.5 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, an oil phase 5 was prepared.

Example 6

A toner of Example 6 was prepared in the same manner as in Example 1 except that the procedures in the Preparation of Oil Phase were changed as follows.

Preparation of Oil Phase

In a vessel, 58 parts of ethyl acetate, 25 parts of the wax dispersion liquid 1, 25 parts of the crystalline polyester resin C4 dispersion liquid, 58 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, an oil phase 6 was prepared.

Example 7

A toner of Example 7 was prepared in the same manner as in Example 1 except that the procedures in the Preparation of Oil Phase were changed as follows.

Preparation of Oil Phase

In a vessel, 58 parts of ethyl acetate, 25 parts of the wax dispersion liquid 2, 25 parts of the crystalline polyester resin C2 dispersion liquid, 58 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, an oil phase 7 was prepared.

Example 8

An aqueous dispersion of fine particles of the crystalline polyester resin C2 was prepared by mixing 79 parts of water, 1 part of sodium dodecylbenzenesulfonate, and 20 parts of the crystalline polyester resin C2 under heat using a NANOVATER manufactured by YOSHIDAKIKAI CO., LTD.

An aqueous dispersion of fine particles of the amorphous polyester resin L was prepared by mixing 79 parts of water, 1 part of sodium dodecylbenzenesulfonate, and 20 parts of the amorphous polyester resin L under heat using a NANOVATER manufactured by YOSHIDAKIKAI CO., LTD.

An aqueous dispersion of fine particles of the amorphous polyester resin H was prepared by mixing 79 parts of water, 1 part of sodium dodecylbenzenesulfonate, and 20 parts of the amorphous polyester resin H under heat using a NANOVATER manufactured by YOSHIDAKIKAI CO., LTD.

An aqueous dispersion of fine particles of ester wax was prepared by mixing 79 parts of water, 1 part of sodium dodecylbenzenesulfonate, and 20 parts of an ester wax (release agent) WEP-3 manufactured by NOF CORPORATION under heat using a NANOVATER manufactured by YOSHIDAKIKAI CO., LTD.

An aqueous dispersion of carbon black was prepared by mixing 75 parts of water, 5 parts of sodium dodecylbenzenesulfonate, and 20 parts of a carbon black (NIPEX 60 manufactured by Degussa) under heat using a NANOVATER manufactured by YOSHIDA KIKAI CO., LTD.

Aggregation

First, 5 parts of the aqueous dispersion of fine particles of the crystalline polyester resin C2, 63 parts of the aqueous dispersion of fine particles of the amorphous polyester resin L, 20 parts of the aqueous dispersion of fine particles of the amorphous polyester resin H, 5 parts of the aqueous dispersion of fine particles of ester wax, and 5 parts of the aqueous dispersion of carbon black were mixed. While heating the mixture, a flocculating salt ($AlCl_3$) was added to the mixture. As a result, particles having a volume average particle diameter of 6.4 μm were prepared.

Washing and Drying

After 100 parts of the dispersion slurry was filtered under reduced pressures:

(1) The filter cake was mixed with 100 parts of ion-exchange water using a TK HOMOMIXER at a revolution of 12,000 rpm for 10 minutes and thereafter filtered.

(2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures.

(3) 100 parts of a 10% aqueous solution of hydrochloric acid was added to the filter cake of (2) and mixed therewith using a TK HOMOMIXER at a revolution of 12,000 rpm for 10 minutes, followed by filtration.

(4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake.

The filter cake was dried by a circulating air dryer at 45° C. for 48 hours and then filtered with a mesh having an opening of 75 μm. Thus, a mother toner 8 was prepared. The volume average particle diameter of the mother toner was 6.4 μm.

Next, 98 parts of the mother toner 8, 1.0 part of HDK-1303 available from Clariant (Japan) K.K., 1.0 part of JMT-1501B available from Tayca Corporation were mixed using a HENSCHEL MIXER. The mixture was sieved with a mesh having an opening of 25 μm. Thus, a toner of Example 8 was prepared.

Example 9

First, 5 parts of the crystalline polyester resin C2, 58 parts of the amorphous polyester resin L, 20 parts of the amorphous polyester resin H, 10 parts of the master batch 1, and 5 parts of an ester wax (release agent) WEP-3 manufactured by NOF CORPORATION were mixed by a mixer. The mixture was thereafter melt-kneaded by a two-roll mill, and the kneaded product was rolled and cooled. Subsequently, a pulverization was performed by a collision-plate-type pulverizer (Impact Type Jet Mill manufactured by Nippon Pneumatic Mfg. Co., Ltd.) and air classification using swirl flow was performed by a classifier (Dispersion Separator DS manufactured by Nippon Pneumatic Mfg. Co., Ltd.). Thus, a mother toner 9 having a volume average particle diameter of 6.1 μm was prepared.

Next, 98 parts of the mother toner 9, 1.0 part of HDK-1303 available from Clariant (Japan) K.K., 1.0 part of JMT-1501B available from Tayca Corporation were mixed using a HENSCHEL MIXER. The mixture was sieved with a mesh having an opening of 25 μm. Thus, a toner of Example 9 was prepared.

Example 10

A toner of Example 10 was prepared in the same manner as in Example 1 except that the procedures in the Preparation of Oil Phase were changed as follows.

Preparation of Oil Phase

In a vessel, 58 parts of ethyl acetate, 25 parts of the wax dispersion liquid 1, 25 parts of the crystalline polyester resin C6 dispersion liquid, 58 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, an oil phase 10 was prepared.

Example 11

A toner of Example 11 was prepared in the same manner as in Example 1 except that the procedures in the Preparation of Oil Phase were changed as follows.

Preparation of Oil Phase

In a vessel, 58 parts of ethyl acetate, 25 parts of the wax dispersion liquid 1, 25 parts of the crystalline polyester resin C8 dispersion liquid, 58 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, an oil phase 11 was prepared.

Comparative Example 1

A toner of Comparative Example 1 was prepared in the same manner as in Example 1 except that the procedures in the Preparation of Oil Phase were changed as follows.

Preparation of Oil Phase

In a vessel, 78 parts of ethyl acetate, 25 parts of the wax dispersion liquid 1, 63 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, a comparative oil phase 1 was prepared.

Comparative Example 2

A toner of Comparative Example 2 was prepared in the same manner as in Example 1 except that the procedures in the Preparation of Oil Phase were changed as follows.

Preparation of Oil Phase

In a vessel, 72 parts of ethyl acetate, 25 parts of the wax dispersion liquid 1, 7.5 parts of the crystalline polyester resin C1 dispersion liquid, 61.5 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, a comparative oil phase 2 was prepared.

Comparative Example 3

A toner of Comparative Example 3 was prepared in the same manner as in Example 1 except that the procedures in the Preparation of Oil Phase were changed as follows.

Preparation of Oil Phase

In a vessel, 53 parts of ethyl acetate, 25 parts of the wax dispersion liquid 1, 25 parts of the crystalline polyester resin C1 dispersion liquid, 58 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, a comparative oil phase 3 was prepared.

Comparative Example 4

A toner of Comparative Example 4 was prepared in the same manner as in Example 1 except that the procedures in the Preparation of Oil Phase were changed as follows.

Preparation of Oil Phase

In a vessel, 62.9 parts of ethyl acetate, 25 parts of the wax dispersion liquid 1, 0.5 parts of the crystalline polyester resin C2 dispersion liquid, 62.9 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, a comparative oil phase 4 was prepared.

Comparative Example 5

A toner of Comparative Example 5 was prepared in the same manner as in Example 1 except that the procedures in the Preparation of Oil Phase were changed as follows.

Preparation of Oil Phase

In a vessel, 58 parts of ethyl acetate, 25 parts of the wax dispersion liquid 1, 25 parts of the crystalline polyester resin C3 dispersion liquid, 58 parts of the amorphous polyester resin L, 20 parts of the amorphous polyester resin H, and 10 parts of the master batch 1 were contained and mixed with a TK HOMOMIXER (available from PRIMIX Corporation)

at a revolution of 5,000 rpm for 120 minutes. Thus, a comparative oil phase 5 was prepared.

Comparative Example 6

A toner of Comparative Example 6 was prepared in the same manner as in Example 1 except that the procedures in the Preparation of Oil Phase were changed as follows.

Preparation of Oil Phase

In a vessel, 62.9 parts of ethyl acetate, 25 parts of the wax dispersion liquid 1, 0.5 parts of the crystalline polyester resin C4 dispersion liquid, 62.9 parts of the amorphous polyester resin L, 20 parts of the amorphous polyester resin H, and 10 parts of the master batch 1 were contained and mixed with a TK HOMOMIXER (available from PRIMIX Corporation) at a revolution of 5,000 rpm for 120 minutes. Thus, a comparative oil phase 6 was prepared.

Formulation of Toner

The formulations and manufacturing methods of the toners of Examples 1 to 11 and Comparative Examples 1 to 6 are summarized in Table 2 below.

TABLE 2

| | Formulation (parts by weight) | | | | | | | | | | | | | | |
|---|---|---|---|---|---|---|---|---|---|---|---|---|---|---|---|
| | Crystalline Polyester Resin | | | | | | Amorphous Polyester Resin | | Wax | | | External Additive | | | Manufacturing |
| | C1 | C2 | C3 | C4 | C6 | C8 | L | H | Ester Wax | Paraffin Wax | Carbon | Silica | Titania | Total | Method |
| Ex. 1 | | 2 | | | | | 66.5 | 20 | 5 | | 5 | 1 | 1 | 100 | Dissolution Suspension Method |
| Ex. 2 | | 5 | | | | | 63 | 20 | 5 | | 5 | 1 | 1 | 100 | Dissolution Suspension Method |
| Ex. 3 | | 10 | | | | | 58 | 20 | 5 | | 5 | 1 | 1 | 100 | Dissolution Suspension Method |
| Ex. 4 | | 20 | | | | | 48 | 20 | 5 | | 5 | 1 | 1 | 100 | Dissolution Suspension Method |
| Ex. 5 | | | | 2 | | | 66.5 | 20 | 5 | | 5 | 1 | 1 | 100 | Dissolution Suspension Method |
| Ex. 6 | | | | 5 | | | 63 | 20 | 5 | | 5 | 1 | 1 | 100 | Dissolution Suspension Method |
| Ex. 7 | | 5 | | | | | 63 | 20 | 5 | | 5 | 1 | 1 | 100 | Dissolution Suspension Method |
| Ex. 8 | | 5 | | | | | 63 | 20 | 5 | | 5 | 1 | 1 | 100 | Emulsion Aggregation Method |
| Ex. 9 | | 5 | | | | | 63 | 20 | 5 | | 5 | 1 | 1 | 100 | Kneading Pulverization Method |
| Ex. 10 | | | | | 5 | | 63 | 20 | 5 | | 5 | 1 | 1 | 100 | Dissolution Suspension Method |
| Ex. 11 | | | | | | 5 | 63 | 20 | 5 | | 5 | 1 | 1 | 100 | Dissolution Suspension Method |
| Comp. Ex. 1 | | | | | | | 68 | 20 | 5 | | 5 | 1 | 1 | 100 | Dissolution Suspension Method |
| Comp. Ex. 2 | 2 | | | | | | 66.5 | 20 | 5 | | 5 | 1 | 1 | 100 | Dissolution Suspension Method |
| Comp. Ex. 3 | 5 | | | | | | 63 | 20 | 5 | | 5 | 1 | 1 | 100 | Dissolution Suspension Method |
| Comp. Ex. 4 | | 0 | | | | | 67.9 | 20 | 5 | | 5 | 1 | 1 | 100 | Dissolution Suspension Method |
| Comp. Ex. 5 | | | 5 | | | | 63 | 20 | 5 | | 5 | 1 | 1 | 100 | Dissolution Suspension Method |
| Comp. Ex. 6 | | | | 0 | | | 67.9 | 20 | 5 | | 5 | 1 | 1 | 100 | Dissolution Suspension Method |

With respect to each toner of Examples 1 to 11 and Comparative Examples 1 to 6, the content of cyclic ester in the toner in terms of toluene measured by a thermal extraction gas chromatographic mass spectrometer at a thermal extraction temperature of 160° C. are presented in Table 3 below.

TABLE 3

| | Amount of Cyclic Ester (in terms of toluene) at Thermal Extraction Temp. of 160° C. (ppm) |
|---|---|
| Example 1 | 13 |
| Example 2 | 41.5 |
| Example 3 | 81.5 |
| Example 4 | 178 |
| Example 5 | 3.4 |
| Example 6 | 15.5 |
| Example 7 | 38.5 |
| Example 8 | 42.3 |
| Example 9 | 113 |
| Example 10 | 42.6 |
| Example 11 | 39.8 |
| Comparative Example 1 | 0 |
| Comparative Example 2 | 248 |
| Comparative Example 3 | 790 |
| Comparative Example 4 | 0.65 |
| Comparative Example 5 | 456 |
| Comparative Example 6 | 0.25 |

Evaluation of Toner Properties

Evaluation of Storage Stability

Each of the toners of Examples 1 to 11 and Comparative Examples 1 to 6 in an amount of 50 g was placed in a 200-cc ointment bottle and stored at 50° C. for 24 hours to evaluate storage stability of the toner.

The results of storage stability of each toner are presented in Table 4 below.

In Table 4, those solidified and unusable were evaluated as C, those usable without being solidified were evaluated as A, and those in a state between C and A were evaluated as B.

Evaluation of Low-temperature Fixability

Each of the toners of Examples 1 to 11 and Comparative Examples 1 to 6 was mounted on an image forming apparatus to evaluate low-temperature fixability of the toner.

As the image forming apparatus, a digital monochrome multifunction peripheral MP6054 manufactured by Ricoh Co., Ltd. was used.

A rectangular solid image of 3 cm×15 cm was formed and output on a sheet of PPC paper TYPE 6000 <70W> A4 Machine Direction (manufactured by Ricoh Co., Ltd.) so that the toner deposition amount was 0.4 mg/cm$^2$. The images were output while varying the fixing temperature from 155° C. by decrement of 1° C.

By varying the fixing temperature, the cold offset temperature (lower-limit fixable temperature) was determined.

As the cold offset temperature becomes lower, the toner becomes fixable at lower temperatures, thereby lowering the fixing temperature and reducing energy consumption. In addition, the better the low-temperature fixability of the toner, the less the burden on the fixing device and the longer the life of the fixing device.

The lower-limit fixable temperature of each toner is presented in Table 4 below.

Evaluation of Amount of Generation of Ultrafine Particles

Each of the toners of Examples 1 to 11 and Comparative Examples 1 to 6 was mounted on an image forming apparatus to evaluate the amount of generation of ultrafine particles.

As the image forming apparatus, a digital monochrome multifunction peripheral MP6054 manufactured by Ricoh Co., Ltd was used.

Measurement of the amount of generation of ultrafine particles was performed according to a standard RAL-UZ 171 set by The Blue Angel of Germany. A measurement chamber having a volume of 5 m$^3$ and a particle measuring instrument FMPS 3091 manufactured by TSI Incorporated were used.

The amount of generation of ultrafine particles of each toner is presented in Table 4 below.

TABLE 4

| | Storage Stability | Lower-limit Fixable Temperature (° C.) | Amount of Generation of Ultrafine Particles (number) |
|---|---|---|---|
| Example 1 | A | 128 | 1.6E+11 |
| Example 2 | A | 124 | 2.3E+11 |
| Example 3 | A | 120 | 3.3E+11 |
| Example 4 | A | 118 | 6.7E+11 |
| Example 5 | A | 113 | 9.2E+09 |
| Example 6 | A | 127 | 1.5E+11 |
| Example 7 | A | 125 | 3.2E+11 |
| Example 8 | A | 125 | 2.4E+11 |
| Example 9 | A | 124 | 4.1E+11 |
| Example 10 | B | 129 | 2.3E+11 |
| Example 11 | A | 121 | 2.2E+11 |
| Comparative Example 1 | A | 150 | 1.1E+10 |
| Comparative Example 2 | A | 129 | 1.2E+12 |
| Comparative Example 3 | A | 125 | 2.8E+12 |
| Comparative Example 4 | A | 150 | 9.8E+09 |
| Comparative Example 5 | A | 124 | 1.8E+12 |
| Comparative Example 6 | A | 149 | 9.9E+09 |

In Table 4, "E" represents a power of 10. For example, "E+11" represents "$10^{11}$".

It is clear from the above results that Examples 1 to 11 each provide an environmentally-friendly toner that exhibits excellent low-temperature fixability and generates ultrafine particles in a smaller amount. Further, the toners of Examples 1 to 9 and 11 each provide excellent storage stability in addition to the excellent low-temperature fixing property and the small amount of generation of ultrafine particles.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

a crystalline polyester resin comprising a polycondensed resin of a dicarboxylic acid represented by the following formula (1) with a diol represented by the following formula (2), wherein a content of a cyclic ester represented by the following formula (3) in the toner, measured by a thermal extraction gas chromatographic mass spectrometry at a thermal extraction temperature of 160° C., is from 1 to 200 ppm in terms of toluene:

Formula (1)

$$HOOC-(CH_2)_n-COOH$$

where n represents an integer of from 2 to 12;

Formula (2)

$$HO-(CH_2)_m-OH$$

where m represents an integer of from 2 to 12; and

Formula (3)

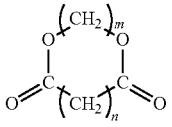

where n represents an integer of from 2 to 12, m represents an integer of from 2 to 12, and m+n≥6 is satisfied, wherein said toner is in the form of a particle.

2. The toner of claim 1, wherein the polycondensed resin accounts for 95% by mol of the crystalline polyester resin.

3. The toner of claim 1, further comprising a polyester resin in an amount of from 50% to 90% by mass of the toner.

4. The toner of claim 1, wherein the content of the cyclic ester is from 5 to 100 ppm in terms of toluene.

5. The toner of claim 1, further comprising an ester wax in an amount of from 2 to 10 parts by mass based on 100 parts by mass of the toner.

6. A toner storage unit comprising:

a container; and the toner of claim 1 stored in the container.

7. An image forming apparatus comprising:

an electrostatic latent image bearer;

an electrostatic latent image forming device configured to form an electrostatic latent image on the electrostatic latent image bearer;

a developing device containing the toner of claim 1, configured to develop the electrostatic latent image formed on the electrostatic latent image bearer with the toner to form a toner image;

a transfer device configured to transfer the toner image formed on the electrostatic latent image bearer onto a surface of a recording medium; and a fixing device configured to fix the toner image on the surface of the recording medium.

* * * * *